US007374354B2

(12) United States Patent
Kawaguchi et al.

(10) Patent No.: US 7,374,354 B2
(45) Date of Patent: May 20, 2008

(54) ARMATURE, WIRE DOT PRINTER HEAD AND WIRE DOT PRINTER

(75) Inventors: Takahiro Kawaguchi, Mishima (JP); Yasunobu Terao, Shizuoka (JP); Keishi Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 393 days.

(21) Appl. No.: 11/073,093

(22) Filed: Mar. 3, 2005

(65) Prior Publication Data

US 2005/0214052 A1 Sep. 29, 2005

(30) Foreign Application Priority Data

Mar. 23, 2004 (JP) ..... 2004-084340

(51) Int. Cl.
*B41J 2/265* (2006.01)

(52) U.S. Cl. ..... 400/124.23; 400/124.01; 400/124.17; 400/124.18

(58) Field of Classification Search ..... 400/124.01, 400/124.17, 124.18, 124.23
See application file for complete search history.

(56) References Cited

U.S. PATENT DOCUMENTS 3,804,224 A 4/1974 Barnaby et al.
4,537,520 A 8/1985 Ochiai et al.
4,552,064 A 11/1985 Sanders, Jr. et al.
4,674,896 A 6/1987 Yasunaga et al.
4,697,939 A 10/1987 Ara
4,723,854 A 2/1988 Sakaida et al.
4,755,645 A 7/1988 Naoki et al.
4,767,227 A 8/1988 Mitsuishi et al.

(Continued)

FOREIGN PATENT DOCUMENTS

JP 60124262 7/1985

(Continued)

OTHER PUBLICATIONS

U.S. Appl. No. 10/940,361, Inventor: Kawaguchi et al., filed Sep. 14, 2004.

(Continued)

*Primary Examiner*—Daniel J. Colilla
*Assistant Examiner*—Kevin D. Williams
(74) *Attorney, Agent, or Firm*—Frishauf, Holtz, Goodman & Chick, P.C.

(57) ABSTRACT

In order to realize a weight saving and prevent a concentration of stress to thereby obtain durability endurable for high-speed printing, an armature of the present invention has an arm that is formed into a long-sized plate-like shape and holds a printing wire at its end section and a magnetic circuit forming member that is positioned at the other end at the side of the printing wire and has a projecting section projecting from the arm toward the direction in which the printing wire extends, wherein a first inclined surface that gradually inclines toward the projecting section in the direction in which the printing wire extends and a concave-shaped first curved surface that communicates with the first inclined surface and bends inward with a predetermined curvature to reach the projecting section are formed at a first end face of the arm at the side of the projecting section.

15 Claims, 5 Drawing Sheets

U.S. PATENT DOCUMENTS

| | | | | |
|---|---|---|---|---|
| 4,802,776 | A | 2/1989 | Miyazawa et al. | |
| 4,820,065 | A | 4/1989 | Koyama et al. | |
| 4,881,832 | A * | 11/1989 | Mitsuishi et al. | 400/124.23 |
| 4,962,876 | A | 10/1990 | Andou et al. | |
| 4,976,554 | A | 12/1990 | Shimosato et al. | |
| 4,988,223 | A | 1/1991 | Hilkenmeier et al. | |
| 4,993,854 | A | 2/1991 | Sato | |
| 5,063,116 | A | 11/1991 | Uchida | |
| 5,074,687 | A | 12/1991 | Gugel | |
| 5,137,377 | A | 8/1992 | Ito et al. | |
| 5,205,659 | A | 4/1993 | Gugel et al. | |
| 5,281,037 | A * | 1/1994 | Asada et al. | 400/124.23 |
| 5,290,112 | A | 3/1994 | Stempfle et al. | |
| 5,527,118 | A * | 6/1996 | Asada et al. | 400/124.24 |
| 5,674,014 | A | 10/1997 | Jordan | |
| 5,975,776 | A | 11/1999 | Groenke | |
| 6,513,997 | B2 | 2/2003 | Terao | |
| 6,543,944 | B2 * | 4/2003 | Horii et al. | 400/124.01 |
| 6,682,233 | B2 | 1/2004 | Terao et al. | |
| 6,698,956 | B1 | 3/2004 | Terao et al. | |
| 6,776,545 | B1 | 8/2004 | Terao | |
| 6,805,503 | B1 | 10/2004 | Tsuchiya et al. | |
| 6,848,843 | B1 | 2/2005 | Kawaguchi | |
| 6,872,016 | B2 | 3/2005 | Kawaguchi | |
| 6,994,482 | B2 | 2/2006 | Terao et al. | |
| 7,008,126 | B2 | 3/2006 | Kawaguchi | |
| 7,018,116 | B2 | 3/2006 | Tsuchiya et al. | |
| 7,020,023 | B2 | 3/2006 | Kuramori | |
| 7,048,455 | B2 | 5/2006 | Kawaguchi et al. | |
| 2003/0175063 | A1 | 9/2003 | Terao et al. | |
| 2004/0170461 | A1 | 9/2004 | Kawaguchi | |
| 2005/0053407 | A1 | 3/2005 | Kawaguchi | |
| 2005/0058488 | A1 | 3/2005 | Kawaguchi | |
| 2005/0083764 | A1 | 4/2005 | Kuramori | |
| 2005/0160576 | A1 | 7/2005 | Kawaguchi | |
| 2005/0201797 | A1 | 9/2005 | Kawaguchi et al. | |
| 2005/0201798 | A1 | 9/2005 | Kawaguchi et al. | |
| 2005/0201799 | A1 | 9/2005 | Tsuchiya et al. | |
| 2005/0201800 | A1 | 9/2005 | Tsuchiya et al. | |
| 2005/0201801 | A1 | 9/2005 | Kawaguchi et al. | |
| 2005/0207814 | A1 | 9/2005 | Kawaguchi | |
| 2005/0207815 | A1 | 9/2005 | Terao et al. | |
| 2005/0214052 | A1 | 9/2005 | Kawaguchi et al. | |
| 2006/0029449 | A1 | 2/2006 | Kawaguchi | |
| 2006/0104696 | A1 | 5/2006 | Kawaguchi | |

FOREIGN PATENT DOCUMENTS

| | | | |
|---|---|---|---|
| JP | 62101458 | A | 5/1987 |
| JP | 02-011336 | A | 1/1990 |
| JP | 7-22994 | B2 | 2/1990 |
| JP | 3-007351 | A | 1/1991 |
| JP | 3-39256 | A | 2/1991 |
| JP | 03-191036 | A | 8/1991 |
| JP | 3-288660 | A | 12/1991 |
| JP | 4-002639 | A | 1/1992 |
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-001890 | A | 1/1997 |
| JP | 09-187972 | A | 7/1997 |
| JP | 09-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |
| JP | 2001253102 | A | 9/2001 |

OTHER PUBLICATIONS

U.S. Appl. No. 10/940,362, Inventor: Kawaguchi et al., filed Sep. 14, 2004.

U.S. Appl. No. 10/940,492, Inventor: Tsuchiya et al., filed Sep. 14, 2004.

U.S. Appl. No. 10/940,432, Inventor: Kawaguchi, filed Sep. 14, 2004.

U.S. Appl. No. 10/940,338, Inventor: Kawaguchi et al., filed Sep. 14, 2004.

U.S. Appl. No. 11/073,118, Inventor: Kawaguchi et al., filed Mar. 3, 2005.

U.S. Appl. No. 11/073,117, Inventor: Tsuchiya et al., filed Mar. 3, 2005.

U.S. Appl. No. 11/073,092, Inventor: Kawaguchi et al., filed Mar. 3, 2005.

Related U.S. Appl. No. 11/246,639, filed Oct. 7, 2005; Inventor: T. Kawaguchi.

Related U.S. Appl. No. 11/301,412, filed Dec. 13, 2005; Inventor: T. Kawaguchi.

* cited by examiner

ARMATURE, WIRE DOT PRINTER HEAD AND WIRE DOT PRINTER

CROSS REFERENCE TO RELATED APPLICATION

The present application is based on Japanese Priority Document P2004-084340 filed on Mar. 23, 2004, the content of which is incorporated herein by reference.

BACKGROUND OF THE INVENTION

1. Field of the Invention

The present invention relates to a wire dot printer, a wire dot printer head used for the wire dot printer and an armature used for the wire dot printer, and more particularly to a shape of the armature.

2. Discussion of the Background

There has been known a wire dot printer head wherein an armature with a printing wire coupled thereto is pivoted between a printing position and a stand-by position, and when the armature is pivoted to the printing position, a tip of the wire is brought into collision with a printing medium to effect printing. In a certain wire dot printer head of this type, there has been proposed a device wherein a magnetic flux is produced by a coil around the armature, that is to be pivoted, for forming a magnetic circuit that causes the armature to be attracted from a stand-by position to a printing position to effect printing.

The wire dot printer head of this type is required to pivot the armature at high speed between the printing position and the stand-by position with a recent increased printing speed. Therefore, weight saving of an armature, particularly a reduced thickness of an armature has been developed. However, performing a carburizing process to the weight-saved armature deteriorates durability at the joint section between a thick section and a thin section of the armature. In view of this, JPA Hei-4(1992)-169242 proposes that the thick section and the thin section of the armature are joined by a communicating section having a taper section or a curved surface section, thereby preventing the deterioration in durability of the armature due to the carburizing process. Further, the armature is composed of an arm that supports a wire and a magnetic circuit forming member that is provided at the arm for forming a magnetic circuit, wherein the arm and the magnetic circuit forming member are independently carburized, which prevents the deterioration in durability of the armature due to the carburizing process.

However, the armature is required to be violently pivoted as many as 2500 times per second between the printing position and the stand-by position with a recent increased printing speed. In this case, the armature disclosed in JPA Hei-4(1992)-169242 is damaged since stress is concentrated on the communicating section of the armature. This is because the thin section of the armature bends so as to be warped in the direction parallel to the wire, which causes stress to be concentrated at the upper and lower sections at the communicating section in the direction parallel to the wire. It should be noted that the communicating section is formed such that the thin section is made thick in its thickness direction (in the direction orthogonal to the wire), so that it is difficult to prevent the concentration of stress at the upper and lower sections at the communicating section in the direction parallel to the wire.

Even in case where an armature 100 is composed of an arm 102 supporting a wire 101 and a magnetic circuit forming member 103, the arm 102 bends so as to be warped in the direction parallel to the wire 101 as shown in FIG. 6, resulting in that stress 104 is concentrated at the upper and lower sections at the arm 102 positioned in the vicinity of the magnetic circuit forming member 103 in the direction parallel to the wire 101. This damages the arm 102 from the stressed section.

SUMMARY OF THE INVENTION

An object of the present invention is to prevent a concentration of stress at the armature to thereby give to the armature durability endurable for high-speed printing.

An armature of the present invention has a flat plate shaped arm having one side and another side at each opposite side thereof, that holds an end section of a printing wire at an end of the one side so as to be orthogonal to its thickness direction, a magnetic circuit forming member for forming a magnetic circuit, that holds the another side of the arm and has a projecting section projecting from the arm toward the direction in which the printing wire extends, and a first end face formed at the arm at same side of the projecting section. The first end face has a first orthogonal surface that extends from the one side of the arm toward the magnetic circuit forming member so as to be orthogonal to the printing wire, a first inclined surface that communicates with the first orthogonal surface and gradually inclines toward the projecting section in the direction in which the printing wire extends, and a concave shaped first curved surface that communicates with the first inclined surface and bends inward with a predetermined curvature to reach the projecting section.

A wire dot printer head according to the present invention includes a printing wire, the above-mentioned armature, a support member that pivotably supports the armature in the direction generally parallel to the printing wire and a core mounted at the position opposite to the magnetic circuit forming member of the armature in the pivotal direction of the armature and having a coil wound therearound.

A wire dot printer according to the present invention includes the wire dot printer head, a platen opposite to the wire dot printer head, a carriage that holds the wire dot printer head and reciprocates along the platen and a printing medium transporting section that transports a printing medium between the wire dot printer head and the platen.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments for carrying out the present invention will be explained with reference to FIGS. 1 to 5.

[Wire Dot Printer Head]

Figure 1:
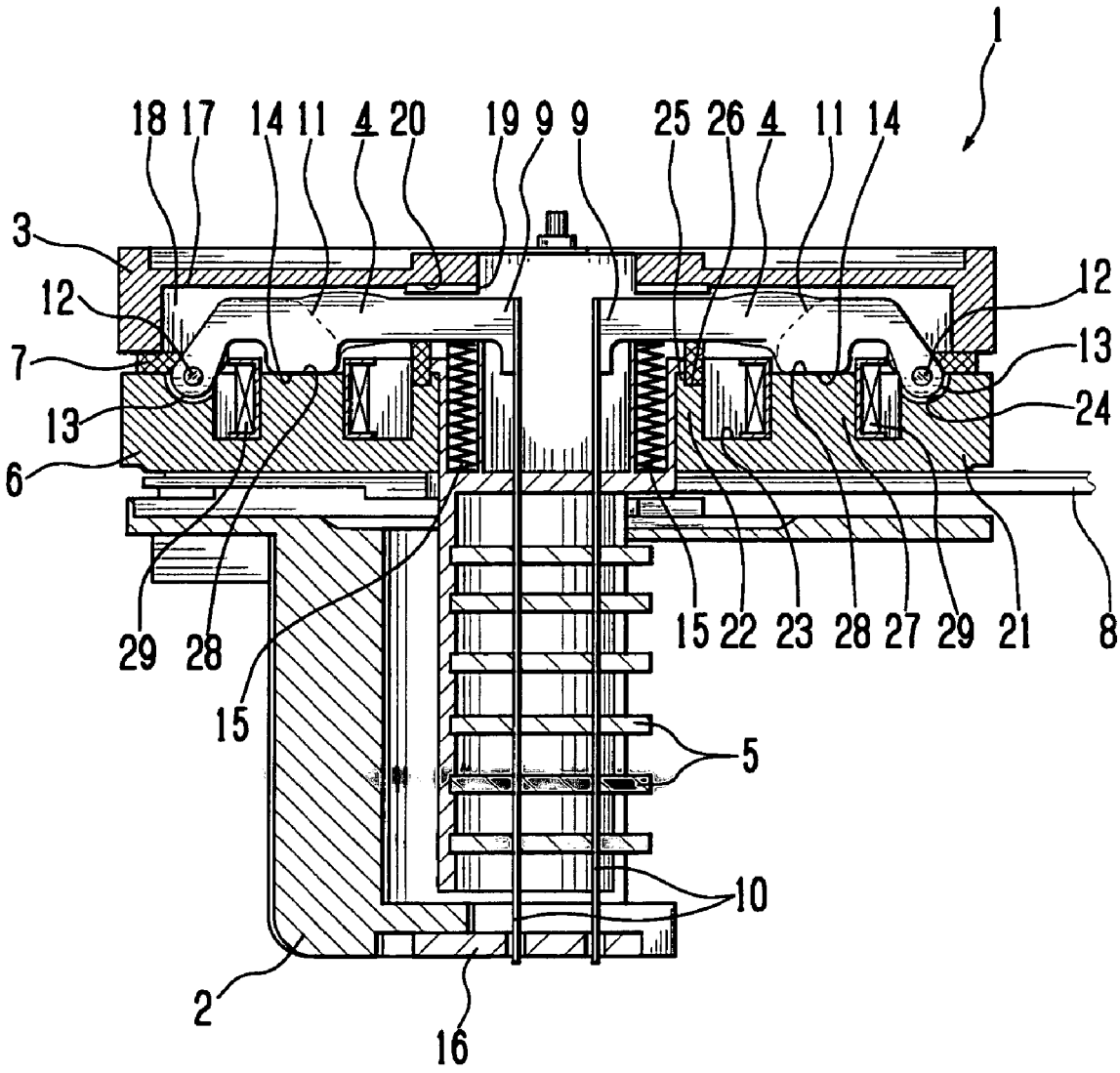
FIG. 1 is a front view in central vertical section schematically showing a wire dot printer head according to one embodiment of the present invention.
Figure 2:
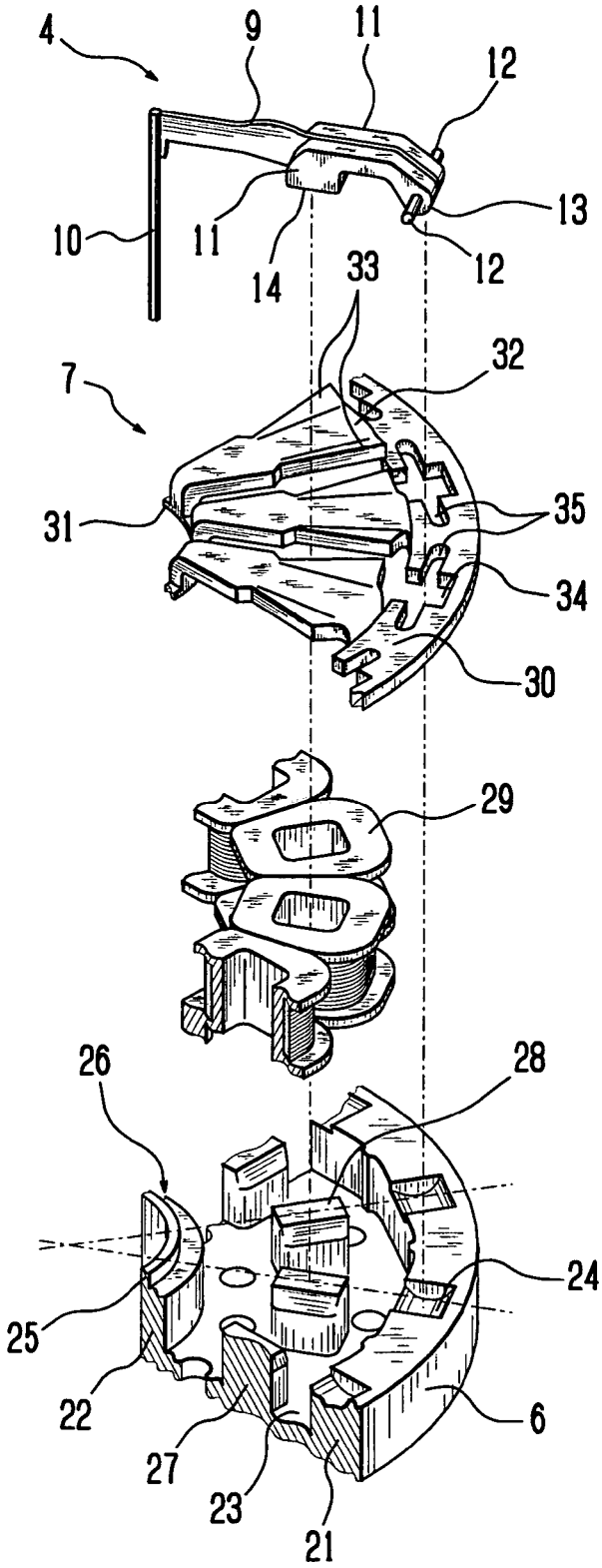
FIG. 2 is an exploded perspective view schematically showing a part of the wire dot printer head according to one embodiment of the present invention.
Figure 3:
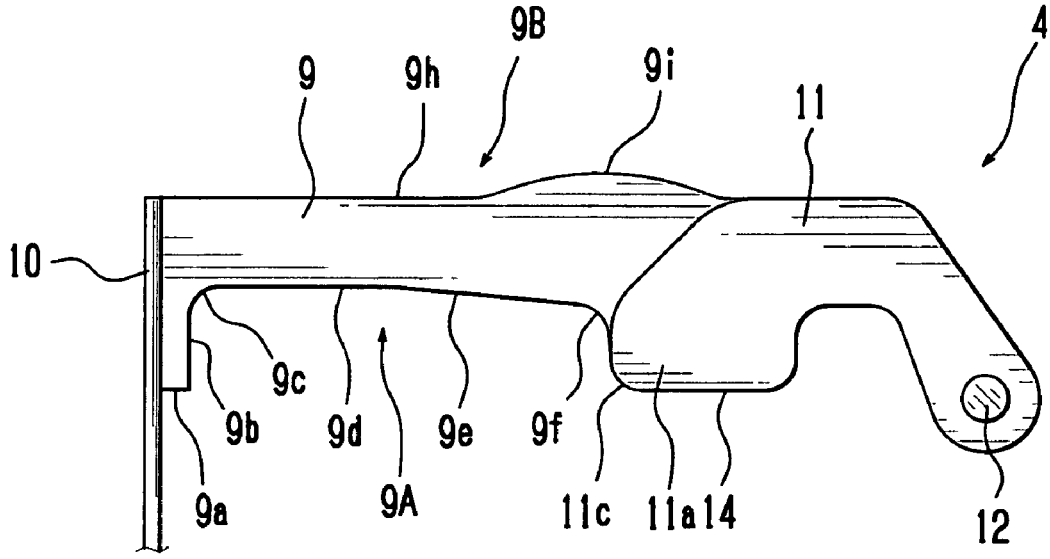
FIG. 3 is a side view schematically showing an armature provided at the wire dot printer head according to one embodiment of the present invention.

Firstly, the entire construction of a wire dot printer head 1 will be explained with reference to FIGS. 1 to 3. FIG. 1 is a front view in central vertical section schematically showing a wire dot printer head 1 according to the embodiment and FIG. 2 is an exploded perspective view schematically showing a part of the wire dot printer head 1.

The wire dot printer head 1 has a front case 2 and a rear case 3 coupled together with a mounting screw (not shown). Disposed between the front case 2 and the rear case 3 are armatures 4, wire guides 5, yoke 6, armature spacer 7 and circuit board 8.

Each of the armatures 4 has an arm 9 that is formed into a plate-like shape and supports a printing wire (hereinafter simply referred to as a wire) 10 at one end thereof in the lengthwise direction (in the direction in which the arm 9 extends), magnetic circuit forming members 11 formed at both side faces of the arm 9 in the widthwise direction for forming a magnetic circuit and a pivot shaft 12 that is rendered to be a center of the pivot. The wire 10 is soldered to one end of the arm 9. An arc-shaped section 13 is formed at the other end of the armature 4. An attracted face 14 is formed at each of the magnetic circuit forming members 11. This attracted face 14 is positioned at the central section of the armature 4 in the lengthwise direction.

Plural armatures 4 described above are radially arranged with respect to the center of the yoke 6. Each of the armatures 4 is held at the surface of the yoke 6 such that it is pivotable in the direction away from the yoke 6 with the pivot shaft 12 as a center, and it is urged by an urging member 15 such as a coil spring toward the direction away from the yoke 6. The urging member 15 is provided for executing the urging operation.

Each of the wire guides 5 slidably guides the wire 10 for causing the tip of the wire 10 to strike against the predetermined position of a printing medium. Further, provided at the front case 2 is a tip guide 16 that aligns the tip of the wire 10 in a predetermined pattern and slidably guides the wire 10. It should be noted that the wire 10 moves to a position where the tip thereof strikes against the predetermined position, e.g., the printing medium such as a sheet or the like, with the pivotal movement of the armature 4, when the armature 4 pivots to the printing position.

A cylindrical section 18 having a bottom face section 17 at the side of one end is provided at the rear case 3. A mounting recess section 20 to which a metallic annular armature stopper 19 is attached is formed at the central portion of the bottom face section 17. The mounting of the armature stopper 19 is performed by fitting the armature stopper 19 into the mounting recess 20. When the armature 4 pivots from the printing position by the urging member 15, the arm 9 as part of the armature 4 comes into contact with the armature stopper 19, thereby stopping the pivotal movement of the armature 4. Therefore, the armature stopper 19 has a function for defining the stand-by position of the armature 4.

The circuit board 8 has a driving circuit for controlling the pivotal movement of the armature 4 between the printing position and the stand-by position. The driving circuit of the circuit board 8 selectively pivots an optional armature 4 among plural armatures 4 during the printing operation.

The yoke 6 is made of a magnetic material and has a pair of cylindrical sections 21 and 22 that are concentrically mounted, each having a different diameter. The size in the shaft direction (in the vertical direction in FIG. 1, i.e., in the shaft direction of the yoke 6) of each cylindrical section 21 and 22 is set equal to each other. The cylindrical section 21 at the outer periphery side and the cylindrical section 22 at the inner periphery side are formed integral by a bottom face 23 formed so as to close one end in the shaft direction. The yoke 6 is held between the front case 2 and the rear case 3 in a state in which its open side opposite to the bottom face 23 is opposed to an open, opposite end side of the rear case 3.

Formed at the outer periphery-side cylindrical section 21 are plural recesses 24 that are equal in number of the armatures 4. Each of the recesses 24 has the inner peripheral face formed into a concave shape having a curvature radius approximately same as that of the outer peripheral face of the arc-shaped section 13 of the armature 4. The arc-shaped section 13 formed at one end of the armature 4 is slidably fitted into the recess 24.

A fitted section 25 having an annular shape is provided at the inner periphery-side cylindrical section 22. The fitted section 25 is integrally provided with the inner periphery-side cylindrical section 22 so as to be positioned concentric with the inner periphery-side cylindrical section 22. The outer diameter of the fitted section 25 is set smaller than the outer diameter of the inner periphery-side cylindrical section 22. Accordingly, a step section 26 is formed at the inner periphery-side cylindrical section 22 by the fitted section 25.

Provided integral with the bottom face 23 are plural cores 27 annually arranged between the outer periphery-side cylindrical section 21 and the inner periphery-side cylindrical section 22. The size of each core 27 in the shaft direction of the yoke 6 is set equal to the size of each cylindrical section 21 and 22 in the shaft direction of the yoke 6.

A pole face 28 is formed at one end of each core 27 in the shaft direction of the yoke 6. The pole face 28 of the core 27 is formed so as to oppose to the attracted face 14 of the magnetic circuit forming member 11 provided at the armature 4. Moreover, a coil 29 is wound around the outer periphery of each core 27. Specifically, the yoke 6 has plural cores 27 annually arranged, each core having the coil 29 wound therearound. Although the winding directions of all coils are set equal to one another in this embodiment, the invention is not limited thereto. For example, coils having different winding directions may be selectively arranged.

The armature spacer 7 has a pair of ring-shaped members 30 and 31 having diameters approximately equal to the diameters of the cylindrical sections 21 and 22 of the yoke 6 and plural guide members 32 radially bridged between the ring-shaped members 30 and 31 so as to be positioned between the armatures 4. These guide members 32 form a side magnetic path with respect to the armature 4. The outer periphery-side ring-shaped member 30 and the inner periphery-side ring-shaped member 31 are concentrically provided. The outer periphery-side ring-shaped member 30, the inner periphery-side ring-shaped member 31 and the guide member 32 are integrally formed.

When the armature spacer 7 is disposed on the yoke 6, the outer periphery-side ring-shaped member 30 and the inner periphery-side ring-shaped member 31 come in contact with the cylindrical sections 21 and 22 of the yoke 6, whereby the inner periphery-side ring-shaped member 31 is fitted to the fitted section 25. It should be noted that the inner diameter of the inner periphery-side ring-shaped member 31 is set equal to or slightly greater than the outer diameter of the fitted section 25.

Each guide member 32 has a side yoke section 33 extending substantially radially of the ring-shaped members 30 and 31 toward the direction away from the pole face 28 of the core 27 and in the oblique direction. This side yoke section 33 has a blade-like shape that is wider toward the outer periphery-side ring-shaped member 30 from the inner periphery-side ring-shaped member 31.

Since the armature spacer 7 has plural guide members 32 bridged between a pair of ring-shaped members 30 and 31, slit-like guide grooves 34 are ensured that are open along the radius direction of the ring-shaped members 30 and 31. Each guide groove 34 is formed to have a width such that the side yoke section 33 comes close to the associated magnetic circuit forming member 11 to such an extent that it does not obstruct the pivot movement of the armature 4.

Further, the guide groove 34 communicates with the outer periphery-side ring-shaped member 30. Formed at the guide groove 34 at the outer periphery-side ring-shaped member 30 is a bearing groove 35 that is a cut-out section open contiguously to the guide groove 34 at the position of both side faces of the guide groove 34 along the outer diameter direction of the ring-shaped member 30. The pivot shaft 12 of the armature 4 is fitted into this bearing groove 35. Specifically, the pivot shaft 12 of the armature 4 is held by the yoke 6 and the armature spacer 7 such that the armature 4 opposes to the core 27.

A pressing member (not shown) for pressing the pivot shaft 12 of each of the plural armatures 4 fitted into the bearing groove 35 is mounted on the armature spacer 7. The pressing member is a plate-like member for pressing the pivot shaft 12 of each of the plural armatures 4 by coupling the front case 2 and the rear case 3 with a mounting screw. This pressing member is annually formed so as not to hinder the pivotal movement of the armature 4.

Figure 4:
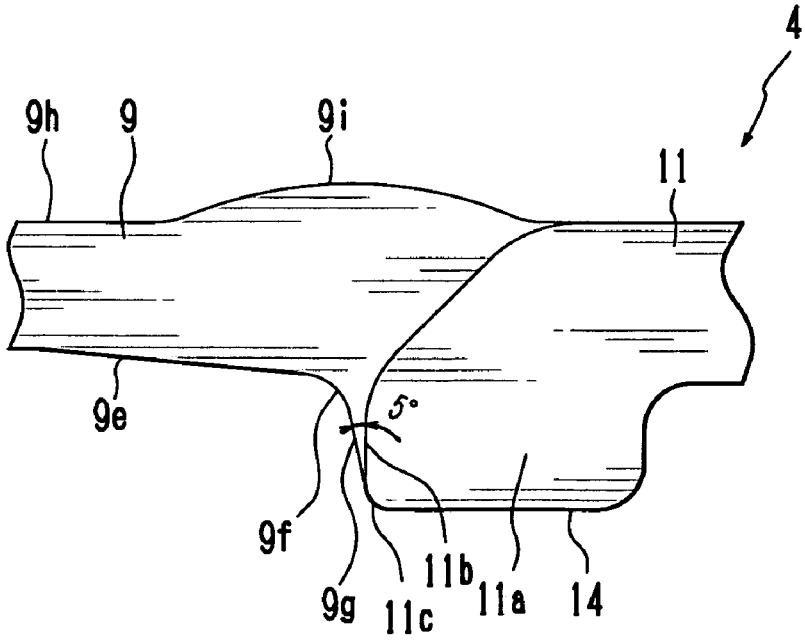
FIG. 4 is a side view schematically showing an enlarged part of an armature provided at the wire dot printer head according to one embodiment of the present invention.

The structure of the armature 4 will be explained here with reference to FIG. 3 and FIG. 4. FIG. 3 is a side view schematically showing the armature 4, while FIG. 4 is a side view schematically showing the armature 4 as partially enlarged.

The arm 9 is formed into a long-sized plate-like shape. The arm 9 is formed into a long-sized flat plate shape from, for example, SK-5 material, and has a thickness of 0.20 mm in this embodiment. The arm 9 described above holds the end section of the wire 10 so as to be generally orthogonal to its thickness direction (widthwise direction) at the end section thereof in its lengthwise direction. Further, the magnetic circuit forming member 11 is provided to the arm 9 so as to be positioned at the other end opposite to the wire 10. The magnetic circuit forming member 11 has a projecting section 11*a* that projects toward the direction in which the wire extends from the arm 9. This projecting section 11*a* has an attracted face 14 that is a third end face generally orthogonal to the wire 10 and a plane 11*b* that is a fourth end face positioned at the side of the wire 10 and generally orthogonal to the attracted face 14. The projecting section 11*a* described above is provided with an angular section 11*c* made by the attracted face 14 and the plane 11*b*. Specifically, the angular section 11*c* is the section where the attracted face 14 and the plane 11*b* cross each other. The angular section 11*c* has an R-shaped section in this specification, but it is not limited thereto.

The arm 9 has a first end face 9A and second end face 9B that oppose to each other in the direction generally parallel to the wire 10. The first end face 9A is positioned in the direction in which the wire 10 extends compared to the second end face 9B and positioned at the side of the projecting section 11*a* of the arm 9. If the direction in which the wire 10 extends is defined as a downward direction, the first end face 9A is a bottom face and the second end face 9B that is positioned upward from the first end face 9A is a top face.

The first end face 9A at the side of the projecting section 11*a* of the arm 9 has an orthogonal surface 9*a* that extends so as to be orthogonal to the wire 10 from one end that supports the wire 10 (the side of the wire 10) toward the magnetic circuit forming member 11, a vertical surface 9*b* that extends generally vertical to the orthogonal surface 9*a* in the direction reverse to the direction in which the wire 10 extends, a curved surface 9*c* having a concave shape curving inward with a predetermined curvature so as to communicate with the vertical surface 9*b*, a first orthogonal surface 9*d* that communicates with the curved surface 9*c* and extends towards the magnetic circuit forming member 11 so as to be generally orthogonal to the wire 10, a first inclined surface that communicates with the first orthogonal surface 9*d* and extends toward the projecting section 11*a* so as to gradually incline toward the direction in which the wire 10 extends and a first curved surface 9*f* of a concave shape that communicates with the first inclined surface 9*e* and curves inward with a predetermined curvature to reach the projecting section 11*a*.

The first orthogonal surface 9*d* extends up to the generally center between from the one end supporting the wire 10 to the magnetic circuit forming member 11. The first inclined surface 9*e* communicates with the first orthogonal surface 9*d* and gradually inclines so as to increase the height (the length in the direction parallel to the wire 10) of the arm 9. The first curved surface 9*f* communicates with the first inclined surface 9*e* and bends inward with the predetermined curvature so as to increase the height of the arm 9. The first curved surface 9*f* is formed in the vicinity of the magnetic circuit forming member 11 (at the root section of the arm 9). Moreover, the first curved surface 9*f* has a second inclined surface 9*g* that gradually inclines toward the projecting section 11*a* in the direction in which the wire 10 extends (see FIG. 4). The second inclined surface 9*g* has a predetermined angle, e.g., approximately 5 degrees, with respect to the plane 11*b* of the projecting section 11*a*, and extends up to the angular section 11*c* of the projecting section 11*a* to thereby reach the angular section 11*c*.

The length of the arm 9 in the lengthwise direction at each of the first orthogonal surface 9*d*, first inclined surface 9*e* and first curved surface 9*f* is set considering the weight saving of the armature 4 and stress distribution. The first inclined surface 9*e* and the second inclined surface 9*g* linearly incline in section in this embodiment, but they are not limited thereto. For example, they may stepwisely incline or may incline so as to bend inwardly. Further, a part of the first curved surface 9*f* is formed to have an R-shaped section, but it is not limited thereto.

The second end face 9B of the arm 9 opposing to the first end face 9A (i.e., at the opposite side of the projecting section 11*a*) is composed of a second orthogonal surface 9*h* that extends so as to be generally orthogonal to the wire 10 from the one end supporting the wire 10 (at the side of the wire 10) toward the magnetic circuit forming member 11 and a second curved surface 9*i* of a convex shape that opposes to the first curved surface 9*f* and communicates with the second orthogonal surface 9*h* so as to bend outward with a predetermined curvature.

The second orthogonal surface 9*h* extends up to the generally center between from the one end supporting the wire 10 to the magnetic circuit forming member 11. The second curved surface 9*i* bends outward with the predetermined curvature so as to increase the height of the arm 9 (the length in the direction parallel to the wire 10), whereby it rises in a convex manner in the opposite direction to the projecting direction of the projecting section 11 at the magnetic circuit forming member 11. Further, the top of the convex-shaped second curved surface 9*i* is located, for example, at the position opposite to the top of the concave-shaped first curved surface 9*f*. It should be noted that the length of the arm 9 in the lengthwise direction at the second curved surface 9*i* is set considering the weight saving of the armature 4 and stress distribution.

[Wire Dot Printer]

Figure 5:
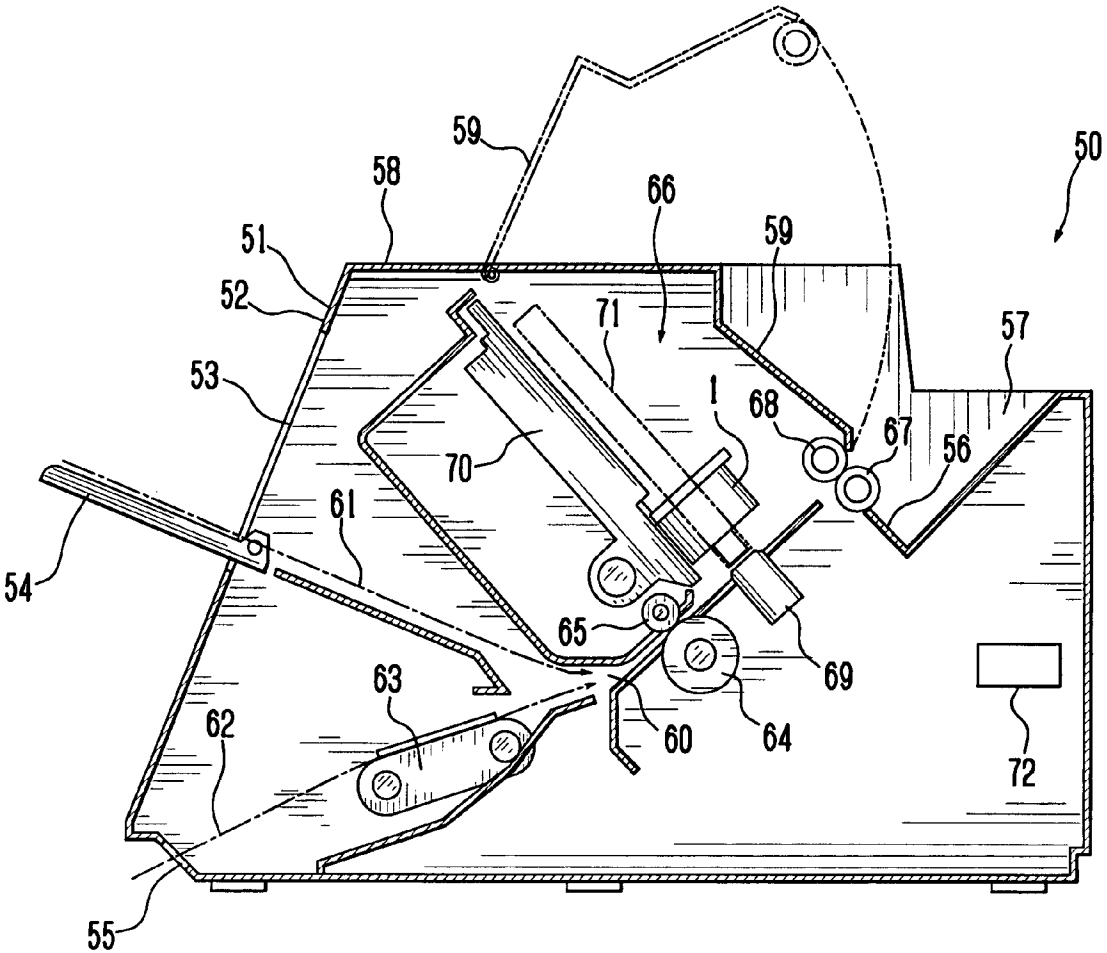
FIG. 5 is a longitudinal side view schematically showing a wire dot printer according to one embodiment of the present invention.
Figure 6:
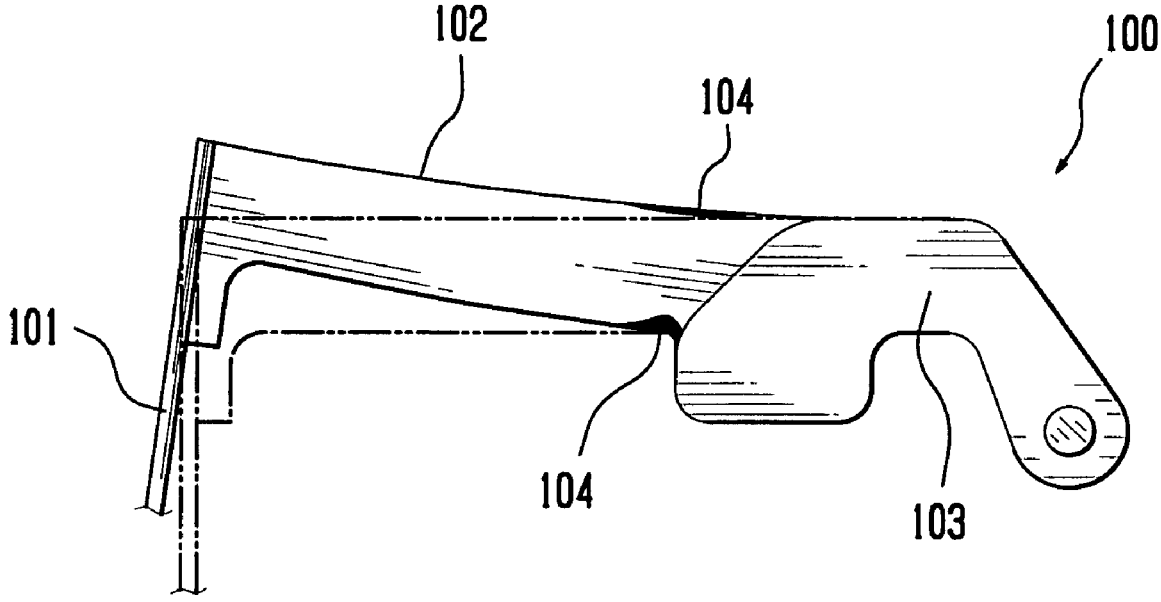
Fig. 6 (PRIOR ART)
FIG. 6 is a side view schematically showing a conventional armature.

Subsequently explained with reference to FIG. 5 is a wire dot printer 50 provided with the wire dot printer head 1 described above. FIG. 5 is a longitudinal side view schematically showing the wire dot printer 50 according to the embodiment of the present invention.

The wire dot printer 50 has a housing case 51. An opening section 53 is formed at the front face 52 of the housing case 51. A manual tray 54 is mounted at the opening section 53 so as to be able to be opened and closed. Further, a paper feed port 55 is provided at the lower section of the front face 52 of the housing case 51, while a discharge tray 57 is provided at the back face side 56. Moreover, an open/close cover 59 is pivotably provided at the top face 58 of the housing case 51. The opened open/close cover 59 is shown by a virtual line in FIG. 5.

A sheet transporting path 60 that is a printing medium transporting path is provided in the housing case 51. The upstream side in the sheet transporting direction of the sheet transporting path 60 communicates with a paper feed path 61 arranged on the extended face of the opened manual tray 54 and a paper feed path 62 communicating with the paper feed port 55. The downstream side in the sheet transporting direction of the sheet transporting path 60 communicates with the discharge tray 57. A tractor 63 for transporting a sheet is provided in the paper feed path 62.

In the sheet transporting path 60, a transporting roller 64 and a pressing roller 65 are arranged so as to be opposite to each other, wherein the pressing roller 65 comes in pressed contact with the transporting roller 64. These transporting roller 64 and the pressing roller 65 transport a sheet that is a printing medium and compose a sheet transporting section that is a printing medium transporting section. Further, disposed in the sheet transporting path 60 is a printer section 66 that performs a printing operation for the transported sheet. A discharge roller 67 is disposed at the inlet of the discharge tray 57. A pressing roller 68 that comes in pressed contact with the discharge roller 67 is pivotably supported at the side of a free end of the open/close cover 59.

The printer section 66 is composed of a platen 69 arranged in the sheet transporting path 60, a carriage 70 that can reciprocate along this platen 69 in the direction orthogonal to the sheet transporting path 60, the above-mentioned wire dot printer head 1 mounted on the carriage 70 and an ink ribbon cassette 71. It should be noted that the ink ribbon cassette 71 is removably mounted.

The carriage 70 is driven by a motor (not shown) to be reciprocated along the platen 69. The wire dot printer head 1 reciprocates in the main scanning direction with the reciprocating movement of the carriage 70 along the platen 69. Therefore, a head driving mechanism can be realized by the carriage 70 or motor in this embodiment. Further, the wire dot printer 50 has incorporated therein a driving control section 72 for controlling each section in the housing case 51. This driving control section 72 drive-controls each section of the printer section 66, tractor 63 and motor.

In this construction, when a single sheet is used as a sheet, it is fed from the manual tray 54. On the other hand, when plural sheets are continuously used, they are fed from the sheet feed port 55. Either sheet (not shown) is transported by the transporting roller 64, printed by the wire dot printer head 1 and discharged onto the discharge tray 57 by the discharge roller 67.

The printing is performed as follows. Specifically, the coil 29 is selectively excited in the wire dot printer head 1, whereby the armature 4 is attracted by the pole face 28 of the core 27 to be pivoted about the pivot shaft 12, resulting in that the wire 10 is pressed toward the sheet on the platen 69 via the ink ribbon (not shown). When the coil 29 is de-energized, the armature 4 returns under the urging force of the urging member 15 and stops at the stand-by position by the armature stopper 19. Although a sheet is used here as the printing medium, the invention is not limited thereto. For example, a pressure-sensitive color-developing paper can be used in which the color development occurs at the pressurized section. In case where the pressure-sensitive color-developing paper is used as the printing medium, the color development occurs at the section pressurized by the pressure of the wire 10 provided at the wire dot printer head 1, to thereby execute the printing.

Upon performing the printing operation by the wire dot printer 50, a coil 29 is selectively energized based upon the printing data by the control of the driving control section 72. Then, a magnetic circuit is formed among the core 27 on which the selected coil 29 is mounted, the magnetic circuit forming members 11 of the armature 4 opposed to the core 27, a pair of side yoke sections 33 opposed to the magnetic circuit forming members 11, guide members 32, the outer- and inner-periphery side cylindrical portions 21, 22 of the yoke 6, the bottom face 23 and again the core 27.

The formation of this magnetic circuit generates attraction force that attracts the magnetic circuit forming members 11 to the pole face 28 of the core 27 between the attracted face 14 of the magnetic circuit forming member 11 and the pole face 28 of the core 27. This attraction force allows the armature 4 to pivot about the pivot shaft 12 in the direction in which the attracted face 14 of the magnetic circuit forming member 11 is attracted to the pole face 28 of the core 27. It should be noted that the position where the attracted face 14 of the magnetic circuit forming member 11 of the armature 4 comes in contact with the pole face 28 of the core 27 is defined as the printing position in this embodiment.

As a result of the pivotal movement of the armature 4 to the printing position, the tip of the wire 10 projects to the side of the sheet. Since the ink ribbon is interposed between the wire dot printer head 1 and the sheet at this time, the pressure from the wire 10 is transmitted to the sheet via the ink ribbon and the ink from the ink ribbon is transferred onto the sheet, thereby carrying out the printing.

When the coil 29 is de-energized, the magnetism so far developed becomes extinct, so that the magnetic circuit also vanishes. Consequently, the attractive force for attracting the magnetic circuit forming member 11 to the pole face 28 of the core 27 disappears, so that the armature 4 is urged away from the yoke 6 with an urging force of the urging member 15 and pivots about the pivot shaft 12 toward the stand-by position. The armature 4 pivots toward the stand-by position until its arm 9 comes into contact with the armature stopper 19, whereupon the armature is stopped at the stand-by position.

The printing operation described above is performed at high speed (for example, the printing speed of 2500 times per second). In this case, the armature 4 pivots between the printing position and the stand-by position with 2500 times per second at high speed. This high-speed printing is realized by providing the first inclined surface 9*e*, the first curved surface 9*f* and the second curved surface 9*i* to the arm 9 of the armature 4. Specifically, the height of the arm 9 (the length in the direction parallel to the wire 10) increases by the first inclined surface 9*e*, first curved surface 9*f* and the second curved surface 9*i* (in particular, the second inclined surface 9*g*), whereby stress applied to the arm 9, especially the stress applied to the root section of the arm 9 is distributed. In this case, the height of the arm 9 does not increase except for the section where the stress is concentrated. Specifically, the height of the arm 9 does not increase more than necessary, so that the arm 9 is reduced in weight while keeping required durability. As described above, the weight saving is realized and the concentration of stress is prevented, thereby being capable of obtaining durability endurable for the high-speed printing. As a result of this, the high-speed printing can be realized. It should be noted that the root section of the arm 9 is a section positioned in the vicinity of the magnetic circuit forming member 11 at the arm 9. The first inclined surface 9*e* and the first curved surface 9*f* in particular can prevent the concentration of stress at the lower section of the root section of the arm 9 in the direction parallel to the wire 10. Further, the second curved surface 9*i* can prevent the concentration of stress at the upper section of the root section of the arm 9 in the direction parallel to the wire 10.

In this embodiment, the second end face 9B of the arm 9 opposing to the first end face 9A is composed of the second orthogonal surface 9*h* that extends so as to be generally orthogonal to the wire 10 from the side of the wire 10 toward the magnetic circuit forming member 11 and the second curved surface 9*i* of a convex shape that opposes to the first curved surface 9*f* and communicates with the second orthogonal surface 9*h* so as to bend outward with a predetermined curvature, thereby surely preventing the concentration of stress to obtain durability endurable for the high-speed printing.

Further, in this embodiment, the projecting section 11*a* has the attracted face 14 that is the third end face generally orthogonal to the wire 10 and the plane 11*b* that is the fourth end face positioned at the side of the wire 10 and generally orthogonal to the attracted face 14, and the first curved surface 9*f* reaches up to the angular section 11*c* made by the attracted face 14 and the plane 11*b*, resulting in surely preventing the concentration of stress to thereby obtain durability endurable for the high-speed printing. Moreover, the first curved surface 9*f* has the second inclined surface 9*g* that inclines at a predetermined angle with respect to the plane 11*b* of the projecting section 11*a*, thereby being capable of surely preventing the occurrence of stress that is to be concentrated on the root section of the arm 9.

Further, the wire dot printer head 1 in this embodiment is provided with the above-mentioned armature 4, the wire 10 provided at the arm 9 of the armature 4, the yoke 6 and the armature spacer 7 that are supporting members for pivotably supporting the armature 10 in the direction substantially parallel to the wire 10 and the core 27 provided at the position opposite to the magnetic circuit forming member 11 of the armature 4 in the pivotal direction of the armature 4 and having the coil 29 wound therearound. Therefore, the concentration of stress is surely prevented, thereby being capable of obtaining durability endurable for the high-speed printing.

Moreover, the wire dot printer 50 in this embodiment is provided with the above-mentioned wire dot printer head 1, platen 69 opposite to the wire dot printer head 1, carriage 70 that holds the wire dot printer head 1 and reciprocates along the platen 69 and transporting roller 64 and the pressing roller 65 serving as the printing medium transporting section for transporting a printing medium between the wire dot printer head 1 and the platen 69, wherein the wire dot printer head 1, carriage 70, transporting roller 64 and the pressing roller 65 are drive-controlled to effect printing based upon printing data. Therefore, the concentration of stress is surely prevented, thereby being capable of obtaining durability endurable for the high-speed printing.

Obviously, numerous modifications and variations of the present invention are possible in light of the above teachings. It is therefore to be understood that within the scope of the appended claims, the invention may be practiced otherwise than as specifically described herein.

What is claimed is:

1. An armature comprising:

a flat plate shaped arm that holds an end section of a printing wire at an end of a first side of the arm such that the arm extends in a direction orthogonal to a thickness direction of the printing wire; and a magnetic circuit forming member, for forming a magnetic circuit, which holds a second side of the arm that is opposite to the first side, and which comprises a projecting section that protects from the arm toward a direction in which the printing wire extends;

wherein the arm includes a first end face at a same side of the arm as the projecting section, and the first end face comprises:

a first orthogonal surface that extends from the first side of the arm toward the magnetic circuit forming member and is orthogonal to the printing wire;

a first inclined surface that communicates with the first orthogonal surface and gradually inclines toward the projecting section in the direction in which the printing wire extends; and a concave shaped first curved surface that communicates with the first inclined surface and bends inward with a predetermined curvature to reach the projecting section; and wherein the arm includes a second end face that is positioned opposite to the first end face, and the second end face comprises:

a second orthogonal surface that extends from the first side of the arm toward the magnetic circuit forming member and is orthogonal to the printing wire; and a convex shaped second curved surface, which is opposite to the first curved surface and communicates with the second orthogonal surface, and which curves outward with a predetermined curvature.

2. An armature comprising:

a flat plate shaped arm that holds an end section of a printing wire at an end of a first side of the arm such that the arm extends in a direction orthogonal to a thickness direction of the printing wire; and a magnetic circuit forming member, for forming a magnetic circuit, which holds a second side of the arm that is opposite to the first side, and which comprises a projecting section that protects from the arm toward a direction in which the printing wire extends;

wherein the arm includes a first end face at a same side of the arm as the projecting section, and the first end face comprises:

a first orthogonal surface that extends from the first side of the arm toward the magnetic circuit forming member and is orthogonal to the printing wire;

a first inclined surface that communicates with the first orthogonal surface and gradually inclines toward the projecting section in the direction in which the printing wire extends; and a concave shaped first curved surface that communicates with the first inclined surface and bends inward with a predetermined curvature to reach the protecting section;

wherein the projecting section includes:

another end face that is orthogonal to the printing wire; and a further end face that is positioned at a side of the projecting section facing toward the printing wire and is orthogonal to said another end face; and wherein the first curved surface of the arm reaches a section where said another end face communicates with said further end face.

3. The armature according to claim 2, wherein the first curved surface of the arm includes a second inclined surface that is inclined at a predetermined angle with respect to said further end face.

4. The armature according to claim 1, wherein the projecting section includes:

a third end face that is orthogonal to the printing wire; and a fourth end face that is positioned at a side of the projecting section facing toward the printing wire and is orthogonal to the third end face, wherein the first curved surface of the arm reaches a section where the third end face communicates with the fourth end face.

5. The armature according to claim 4, wherein the first curved surface of the arm includes a second inclined surface that is inclined at a predetermined angle with respect to the fourth end face.

6. A wire dot printer head comprising:

a printing wire;

an armature comprising:

a flat plate shaped arm that holds an end section of the printing wire at an end of a first side of the arm such that the arm extends in a direction orthogonal to a thickness direction of the printing wire;

a magnetic circuit forming member, for forming a magnetic circuit, which holds a second side of the arm that is opposite to the first side, and which comprises a projecting section projecting from the arm toward a direction in which the printing wire extends;

wherein the arm includes a first end face at a same side of the arm as the projecting section, and the first end face comprises:

a first orthogonal surface that extends from the first side of the arm toward the magnetic circuit forming member and is orthogonal to the printing wire;

a first inclined surface that communicates with the first orthogonal surface and gradually inclines toward the projecting section in the direction in which the printing wire extends; and a concave shaped first curved surface that communicates with the first inclined surface and bends inward with a predetermined curvature to reach the projecting section; and wherein the arm includes a second end face that is positioned opposite to the first end face, and the second end face comprises:

a second orthogonal surface that extends from the first side of the arm toward the magnetic circuit forming member and is orthogonal to the printing wire; and a convex shaped second curved surface, which is opposite to the first curved surface and communicates with the second orthogonal surface, and which curves outward with a predetermined curvature;

a support member that supports the armature such that the armature is pivotable along in a direction generally parallel to the printing wire; and a core, which is mounted at a position opposite to the magnetic circuit forming member of the armature in the pivoting direction of the armature, and around which a coil is wound.

7. A wire dot printer head comprising:

a printing wire;

an armature comprising:

a flat plate shaped arm that holds an end section of the printing wire at an end of a first side of the arm such that the arm extends in a direction orthogonal to a thickness direction of the printing wire;

a magnetic circuit forming member, for forming a magnetic circuit, which holds a second side of the arm that is opposite to the first side, and which comprises a projecting section projecting from the arm toward a direction in which the printing wire extends;

wherein the arm includes a first end face at a same side of the arm as the projecting section, and the first end face comprises:

a first orthogonal surface that extends from the first side of the arm toward the magnetic circuit forming member and is orthogonal to the printing wire;

a first inclined surface that communicates with the first orthogonal surface and gradually inclines toward the projecting section in the direction in which the printing wire extends; and a concave shaped first curved surface that communicates with the first inclined surface and bends inward with a predetermined curvature to reach the projecting section;

wherein the projecting section includes:

another end face that is orthogonal to the printing wire; and a further end face that is positioned at a side of the projecting section facing toward the printing wire and is orthogonal to said another end face; and wherein the first curved surface of the arm reaches a section where said another end face communicates with said further end face;

a support member that supports the armature such that the armature is pivotable along in a direction generally parallel to the printing wire; and a core, which is mounted at a position opposite to the magnetic circuit forming member of the armature in the pivoting direction of the armature, and around which a coil is wound.

8. A wire dot printer head according to claim 7, wherein the first curved surface of the arm includes a second inclined surface that is inclined at a predetermined angle with respect to said further end face.

9. A wire dot printer head according to claim 6, wherein the projecting section includes:

a third end face that is orthogonal to the printing wire; and a fourth end face that is positioned at a side of the projecting section facing toward the printing wire and is orthogonal to the third end face, wherein the first curved surface of the arm reaches a section where the third end face communicates with the fourth end face.

10. A wire dot printer head according to claim 9, wherein the first curved surface of the arm includes a second inclined surface that is inclined at a predetermined angle with respect to the fourth end face.

11. A wire dot printer comprising:

(i) a wire dot printer head comprising:

a printing wire;

an armature comprising:

a flat plate shaped arm that holds an end section of the printing wire at an end of a first side of the arm such that the arm extends in a direction orthogonal to a thickness direction of the printing wire;

a magnetic circuit forming member, for forming a magnetic circuit, which holds a second side of the arm that is opposite to the first side, and which comprises a projecting section projecting from the arm toward a direction in which the printing wire extends;

wherein the arm includes a first end face at a same side of the arm as the protecting section, and the first end face comprises:

a first orthogonal surface that extends from the first side of the arm toward the magnetic circuit forming member and is orthogonal to the printing wire;

a first inclined surface that communicates with the first orthogonal surface and gradually inclines toward the projecting section in the direction in which the printing wire extends; and a concave shaped first curved surface that communicates with the first inclined surface and bends inward with a predetermined curvature to reach the projecting section; and wherein the arm includes a second end face that is positioned opposite to the first end face, and the second end face comprises:

a second orthogonal surface that extends from the first side of the arm toward the magnetic circuit forming member and is orthogonal to the printing wire; and a convex shaped second curved surface, which is opposite to the first curved surface and communicates with the second orthogonal surface, and which curves outward with a predetermined curvature;

a support member that supports the armature such that the armature is pivotable along in a direction generally parallel to the printing wire; and a core, which is mounted at a position opposite to the magnetic circuit forming member of the armature in the pivoting direction of the armature, and around which a coil is wound;

(ii) a platen opposite to the wire dot printer head;

(iii) a carriage that holds the wire dot printer head and reciprocates along the platen; and (iv) a printing medium transporting section that transports a printing medium between the wire dot printer head and the platen.

12. A wire dot printer comprising:

(i) a wire dot printer head comprising:

a printing wire;

an armature comprising:

a flat plate shaped arm that holds an end section of the printing wire at an end of a first side of the arm such that the arm extends in a direction orthogonal to a thickness direction of the printing wire;

a magnetic circuit forming member, for forming a magnetic circuit, which holds a second side of the arm that is opposite to the first side, and which comprises a projecting section projecting from the arm toward a direction in which the printing wire extends;

wherein the arm includes a first end face at a same side of the arm as the projecting section, and the first end face comprises:

a first orthogonal surface that extends from the first side of the arm toward the magnetic circuit forming member and is orthogonal to the printing wire;

a first inclined surface that communicates with the first orthogonal surface and gradually inclines toward the projecting section in the direction in which the printing wire extends; and a concave shaped first curved surface that communicates with the first inclined surface and bends inward with a predetermined curvature to reach the projecting section;

wherein the projecting section includes:

another end face that is orthogonal to the printing wire; and a further end face that is positioned at a side of the projecting section facing toward the printing wire and is orthogonal to said another end face; and wherein the first curved surface of the arm reaches a section where said another end face communicates with said further end face;

a support member that supports the armature such that the armature is pivotable along in a direction generally parallel to the printing wire; and a core, which is mounted at a position opposite to the magnetic circuit forming member of the armature in the pivoting direction of the armature, and around which a coil is wound;

(ii) a platen opposite to the wire dot printer head;

(iii) a carriage that holds the wire dot printer head and reciprocates along the platen; and (iv) a printing medium transporting section that transports a printing medium between the wire dot printer head and the platen.

13. A wire dot printer according to claim 12, wherein the first curved surface of the arm includes a second inclined surface that is inclined at a predetermined angle with respect to said further end face.

14. A wire dot printer according to claim 11, wherein the projecting section includes:

a third end face that is orthogonal to the printing wire; and a fourth end face that is positioned at a side of the projecting section facing toward the printing wire and is orthogonal to the third end face, wherein the first curved surface of the arm reaches a section where the third end face communicates with the fourth end face.

15. A wire dot printer according to claim 14, wherein the first curved surface of the arm includes a second inclined surface that is inclined at a predetermined angle with respect to the fourth end face.

* * * * *